US005231426A

United States Patent [19]

Sweet

[11] Patent Number: 5,231,426

[45] Date of Patent: Jul. 27, 1993

[54] NOZZLELESS DROPLET PROJECTION SYSTEM

[75] Inventor: Richard G. Sweet, Palo Alto, Calif.

[73] Assignee: Xerox Corporation, Stamford, Conn.

[21] Appl. No.: 850,108

[22] Filed: Mar. 12, 1992

Related U.S. Application Data

[63] Continuation-in-part of Ser. No. 634,247, Dec. 26, 1990, abandoned.

[51] Int. Cl.[5] ..... B41J 2/175; B41J 2/065

[52] U.S. Cl. ..... 346/140 R

[58] Field of Search ..... 346/140 R, 75; 137/8

[56] References Cited

U.S. PATENT DOCUMENTS

| | | | |
|---|---|---|---|
| 3,640,214 | 2/1972 | Scheinhutte | 101/45 |
| 4,227,452 | 10/1980 | Tamai | 101/1 |
| 4,308,547 | 12/1981 | Lovelady et al. | 346/140 R |
| 4,368,478 | 1/1983 | Koto | 346/140 R |
| 4,380,770 | 4/1983 | Maruyama | 346/140 R |
| 4,580,148 | 4/1986 | Domoto et al. | 346/140 R |
| 4,751,534 | 6/1988 | Elrad et al. | 346/140 R |
| 4,797,693 | 1/1989 | Quate | 346/140 R |
| 4,801,953 | 1/1989 | Quate | 346/140 R |
| 4,959,674 | 9/1990 | Khri-Yakub et al. | 346/140 R |
| 5,121,141 | 6/1992 | Hadimoglu et al. | 346/140 R |

FOREIGN PATENT DOCUMENTS 1922945 5/1969 Fed. Rep. of Germany .

OTHER PUBLICATIONS

"Focused Acoustic Beams for Nozzleless Droplet Formation", 1988 IEEE Ultrasonics Symposium, 0090-5607/88/0000-0699.

"Nozzleless Droplet Formation with Focused Acoustic Beams", May 1, 1981, J. Appl. Physics 65(9).

*Primary Examiner*—Benjamin R. Fuller

*Assistant Examiner*—Alrick Bobb

*Attorney, Agent, or Firm*—Anglin & Giaccherini

[57] ABSTRACT

An apparatus for a Nozzleless Droplet Projection System (10) is disclosed. The invention employs a novel geometry for producing a thin film of ink (26) having a constant depth traveling at a constant velocity across a tubular transducer head (**16*a*, 16*b*). The head includes a smooth exterior perimetrical surface (18) that faces toward a sheet of paper (14) and a laminar flow regulator (28) that resembles a knife-edge. An array of electro-acoustic transducers (15) submerged beneath the transducer head support surface (17) generates tone bursts (20) of acoustic energy which are focused by a corresponding array of acoustic lenses (19) inscribed along the length of the transducer head (16*a*, 16*b*). A constant thickness and constant velocity fluid film (26) is generated by forcing pre-regulated, pressurized fluid (33) through a narrow slit (30) and across the smooth perimetrical surface (18) of the transducer head (16*a*, 16*b*). The dimensions of the slit (30) are defined by the space separating the laminar flow regulator (28) and the smooth exterior surface (18) of the print head. The ink film (26) is maintained at the acoustic focus of the lenses (19) to control the size of droplets of ink (12) that are ejected from the print head toward a sheet of paper (14). A pattern of droplets (12) is ejected by pulsing the appropriate electro-acoustic transducers (15) as the paper (14) is moved across the apparatus at a constant velocity. The cooperative action of the knife-edge shaped laminar flow regulator (28) and the smooth surface (18) of the print head (16*a*, 16*b*) provides a stable, fixed-depth, non-undulating film down stream from slit (30). The elastic action of a meniscus (46, 48) of fluid formed in slit (30) regulates the fluid velocity and depth along smooth exterior surface (18) during operation of the apparatus (10**).

6 Claims, 4 Drawing Sheets

NOZZLELESS DROPLET PROJECTION SYSTEM

CROSS-REFERENCE TO A RELATED PATENT APPLICATION AND CLAIM FOR PRIORITY

The present patent application is a continuation-in-part application based upon a commonly owned and commonly assigned copending parent application by the same inventor, Richard G. Sweet, entitled "Nozzleless Droplet Projection System", which was filed on Dec. 26, 1990 and which was assigned U.S. Ser. No. 07/634,247, now abandoned. The Applicant hereby claims the benefit of priority of the filing date of the parent application for subject matter common to both applications under Section 119 of Title 35 of the United States Code of Laws.

BACKGROUND OF THE INVENTION

The present invention relates to the field of ink jet printing. More particularly, the present invention is an apparatus that provides a Nozzleless Droplet Projection System which accurately delivers fluid droplets onto a projection surface at very high printing speeds.

A nozzle based droplet projection system is typically used to project ink onto paper in a common ink jet printer, manufactured by the computer peripherals industry. Though these printers tend to be very slow in producing hardcopy, they are an attractive product to many consumers interested in a low cost product. The problem of accurately projecting fluid droplets, such as ink, onto a projection medium, such as paper, at very high rates and low cost has presented a major challenge to designers in the computer peripherals field. Surface contamination problems and clogging of the ink nozzles is a common problem. Limitations in the droplet ejection rate impede the development of a significantly faster system with the current nozzle based technology.

A printer is a device which transfers information, either graphics or text, from a computer medium to hardcopy, such as paper. The speed at which the paper hardcopy may be produced, the clarity and the resolution of the hardcopy are measures of the quality of the printer. Resolution is a measure of the capability of a printer to reproduce fine detail on paper. A printer which produces high resolution output can create a faithful reproduction of the original text or graphics. Higher resolution printers generate a more impressive final product and are, consequently, in greater demand. The technology utilized determines the quality of the printer and its ultimate cost. Ink jet printing is a relatively inexpensive direct marking technology which has been slow to mature at least in part because most "continuous stream" and "drop on demand" ink jet print heads include nozzles. Although steps have been taken to reduce the manufacturing cost and increase the reliability of these nozzles, experience suggests that the nozzles will continue to be a significant obstacle to realizing the full potential of the technology. The development of a straightforward method and apparatus which would allow one to solve the speed and maintainability problems of nozzle based print heads, at a lower cost, would represent a major technological advance in the computer peripheral industry. The enhanced performance which could be achieved using such innovative technology would satisfy a long felt need within the industry.

SUMMARY OF THE INVENTION

The present invention is a Nozzleless Droplet Projection System for projecting droplets of fluid onto a projection surface. The invention employs a novel geometry for developing a thin film of fluid with a constant thickness traveling at a constant velocity across a transducer head. The head structure has a smooth perimetrical exterior surface, and a distribution of submerged electro-acoustic transducers to generate tone bursts of acoustic energy. Each transducer has an associated acoustic lens, to focus the tone bursts onto the surface of the thin fluid film. The focused tone bursts eject droplets of fluid from the fluid film onto the projection surface. The thickness of the fluid film and the flow velocity are maintained constant by a laminar flow regulator such that the position of the exterior surface of the fluid and the head generally coincides with the acoustic focus, and the fluid velocity is generally constant during pressure surges in the fluid supply. Maintaining this spatial relationship produces ejected droplets of a desired diameter. A continuous supply of fluid passes over the head during operation of the projection system.

In the preferred embodiment of the invention, the laminar flow regulator is shaped like a knife-edge. The ink film depth is precisely controlled by the dimensions of the slit through which the fluid flows and by the velocity of the film, which is established by the fluid pressure. The dimensions of the slit are determined by the distance between the laminar flow regulator and the smooth perimetrical surface of the print head.

An appreciation of other aims and objectives of the present invention and a more complete and comprehensive understanding of this invention may be achieved by studying the following description of a preferred embodiment and by referring to the accompanying drawings.

DETAILED DESCRIPTION OF A PREFERRED EMBODIMENT

Figure 1:
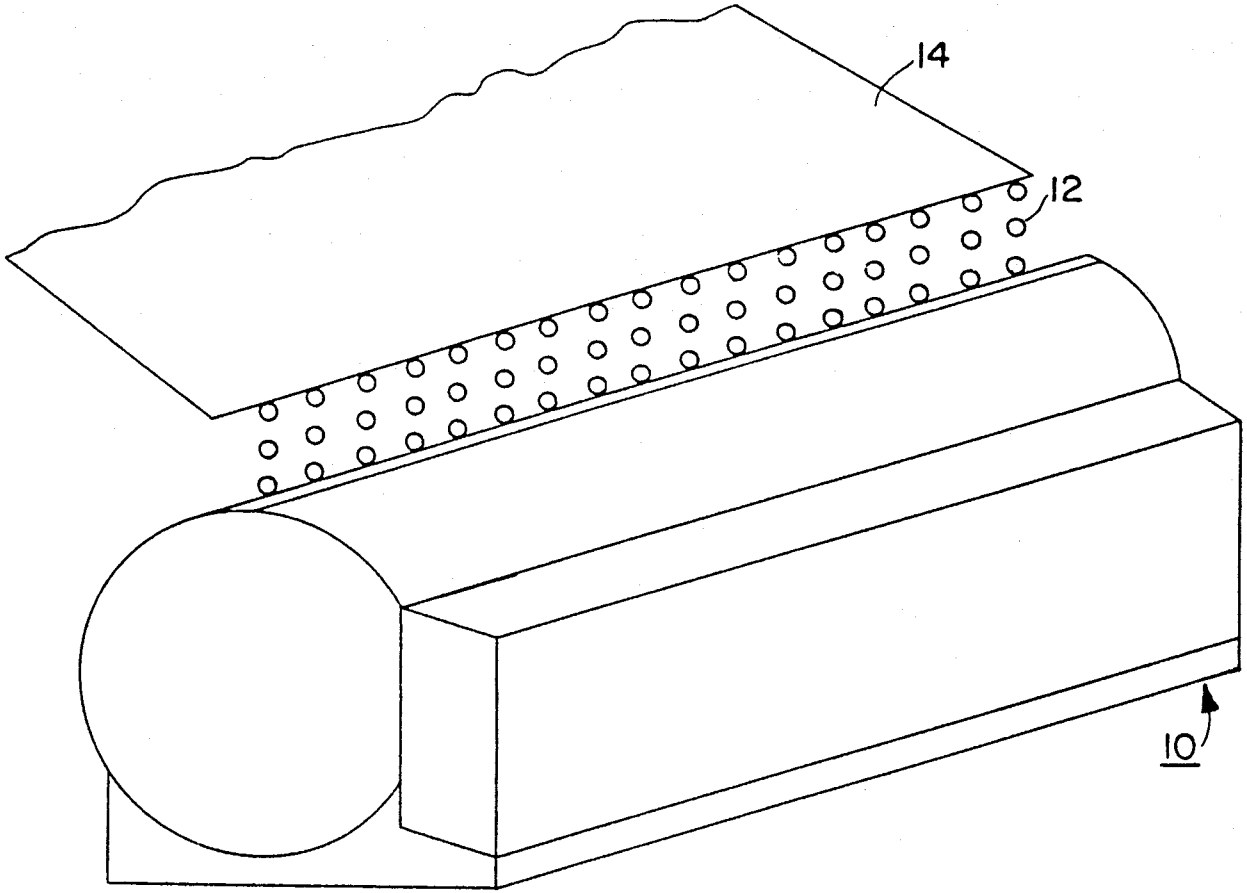
FIG. 1 is a perspective view of the present invention.

FIG. 1 is a perspective view of the apparatus of the present invention 10 for a nozzleless droplet projection system. Fluid droplets 12, such as ink, are projected onto projection surface 14, such as paper, as the projection surface 14 is moved across apparatus 10. The apparatus of the present invention 10 may be conveniently sized to match the width of the projection surface 14 so that only one pass is required to complete a printing process.

Figure 2:
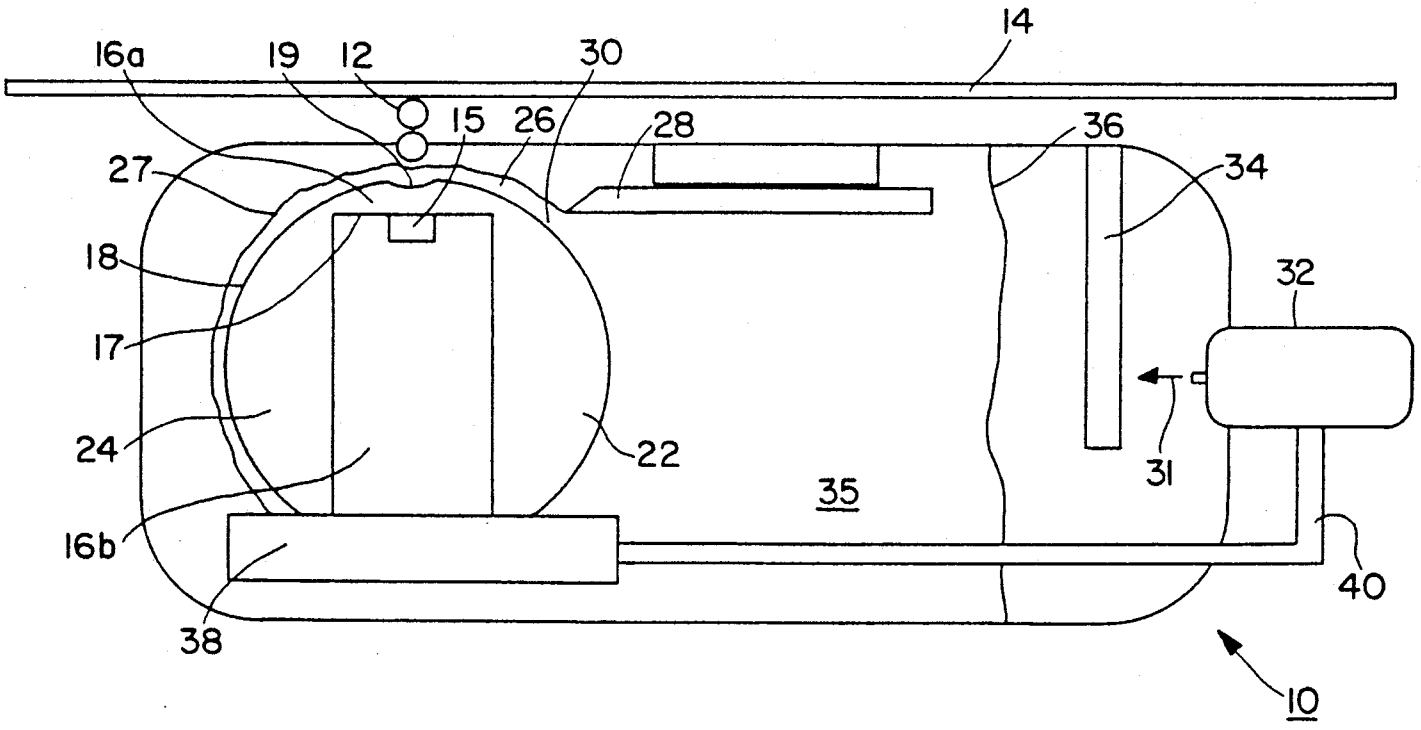
FIG. 2 is a schematic representation of a side view of the Nozzleless Droplet Projection System.

FIG. 2 is a schematic representation of a preferred embodiment of the present invention 10. At least one electro-acoustic transducer 15 is connected to a head structure **16*a* having a head cavity 16*b*. Each electro-acoustic transducer 15 intimately contacts head structure 16*a* at transducer support surface 17. Head structure 16*a* has a smooth perimetrical exterior surface 18 with at least one inscribed acoustic lens 19, which is advantageously aligned with each electro-acoustic transducer 15. Tone bursts 20 of acoustic energy are transmitted through head structure 16***a* to acoustic lens 19 by pulsing an electro-acoustic transducer 15 with an electrical excitation (not shown). The lens shape is preferably spherical, but a Fresnel lens structure (not shown) may be considered as an alternative. The boundaries of the perimetrical exterior surface 18 are defined by the input side 22 and the output side 24 of head structure 16*a*. A laminar flow of fluid 26 is developed across smooth exterior surface 18 by laminar flow regulator 28, which maintains fluid surface 27 at a generally constant distance from the smooth exterior surface 18. This distance is designed to advantageously correspond to the focal distance of the acoustic lens 19 which is utilized. The distance between the fluid surface 29 and the smooth exterior surface 18 may be adjusted by varying the separation or slit 30 between laminar flow regulator 28 and head 16*a* at input side 22. This geometry assures optimum droplet size. Pre-regulated, pressurized fluid 31 is injected into the apparatus 10 by fluid pump 32 in the direction shown. The pressurized fluid input 31 is deflected from baffle 34 and filtered by fluid filter 36. The filtered fluid supply 35 is forced by pump 32 through laminar flow regulator 28 at slit 30. A fluid sump 38 collects the laminar fluid flow 26 from the output side 24 of head structure 16*a* and feeder tube 40 returns the fluid to fluid pump 32 to complete the fluid flow cycle.

Figure 3:
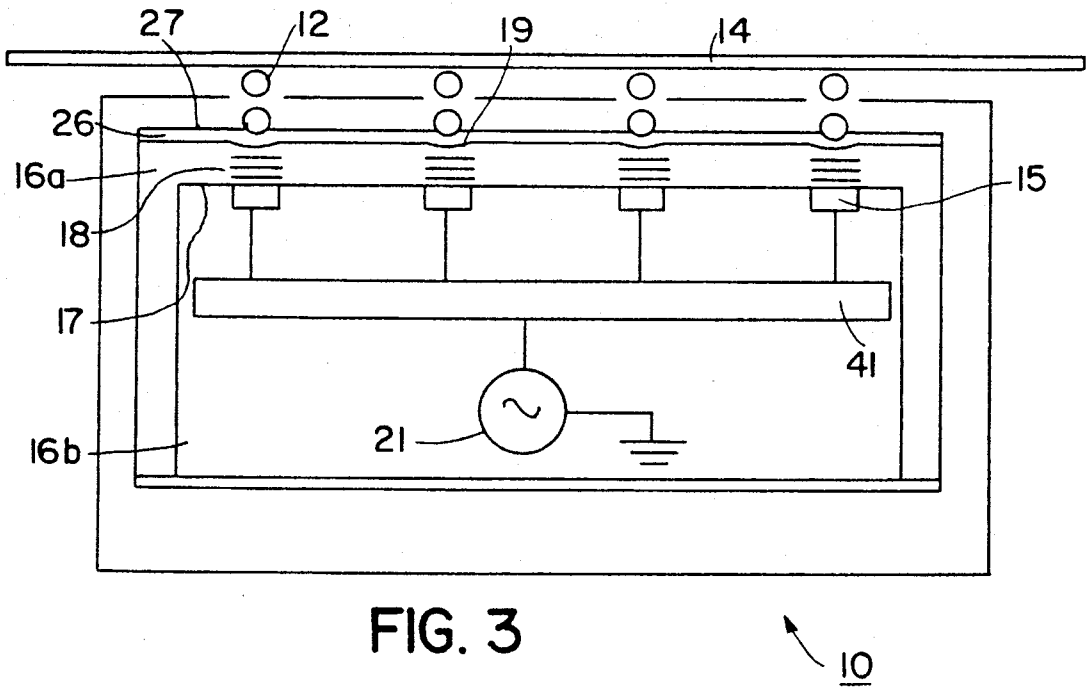
FIG. 3 is a schematic representation of a lengthwise view of the present invention.

FIG. 3 is a schematic representation of the apparatus of the present invention for a preferred embodiment of a nozzleless droplet projection system. A linear array of electro-acoustic transducers 15 with corresponding acoustic lenses 19 is depicted along a length of head structure 16*a*. Head cavity 16*b* and transducer support surface 17 extends along the length of the head structure 16*a*. The number and the relative size of the electro-acoustic transducers 15 and acoustic lenses 19 in the linear array determines the spatial resolution of the projection system. Center-to-center spacings on the order of 50 microns may be considered high resolution for the purpose of droplet 12 ejection onto a projection surface 14. Tone bursts 20 of acoustic energy are shown emanating from an array of electro-acoustic transducers 15 and are transmitted through head structure 16*a*, which has favorable acoustic properties. Electronic power supply 21 is connected to the array of electro-acoustic transducers 15 through an electronic multiplexer 41 which selectively excites any sequence of electro-acoustic transducers 15 to project a desired pattern of droplets 12 onto the projection surface 14. Electronic multiplexer 41 is selectively addressed at very high speeds by a control circuit (not shown) which is external to the apparatus 10.

Figure 4:
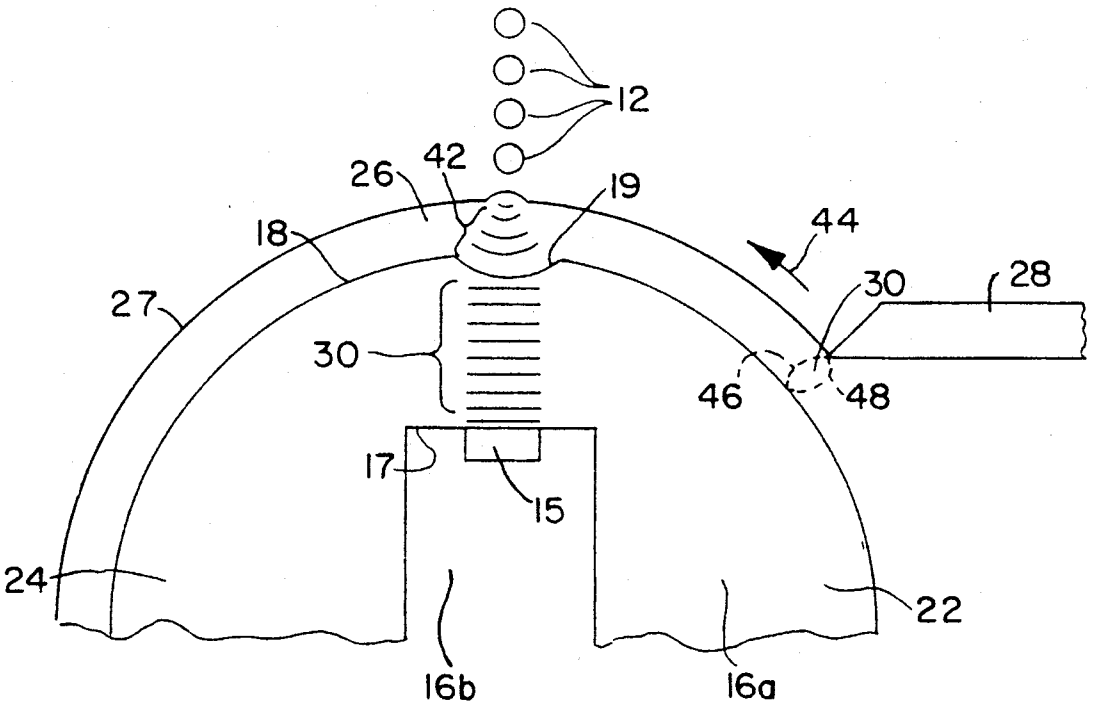
FIG. 4 is a schematic diagram depicting the regulation of fluid flow of the Nozzleless Droplet Projection System.

FIG. 4 is a schematic diagram depicting the focusing action of lens 19 upon acoustic tone bursts 20, creating converging acoustic tone bursts 42, and the regulation of fluid flow in the Nozzleless Droplet Projection System 10. The height of flow surface 27 with respect to the exterior surface 18 of head structure 16*a* is regulated against pressure fluctuations in the filtered fluid supply 35 by laminar flow regulator 28. The preferred embodiment of the invention employs a laminar flow regulator 28 that resembles a knife-edge. The depth of the ink film is precisely controlled by the dimensions of the slit 30. Ink is pushed through the slit 30 by the action of pump 32. The velocity of the film is determined by the regulating action of the pressurized ink passing through the slit 30. The size of the slit 30 is defined by the space that separates the knife-edge 28 and the smooth surface 18 of the print head 16*a*. Due to surface tension forces created by forcing pressurized fluid 35 through narrow slit 30 in the direction shown by reference numeral 44, a pressure increase in the filtered fluid supply 35 essentially creates a convex meniscus 46 and a pressure drop in the filtered fluid supply creates a concave meniscus 48 between laminar flow regulator 28 and exterior surface 18. The elastic action of the fluid within slit 30 tends to regulate the fluid velocity and depth along smooth exterior surface 18 during operation of the apparatus 10. Head structure 16*a* and head cavity 16*b* form a tubular means for supporting the electro-acoustic transducers 15 which may be circular, elliptical or polygonal in cross section. In fact, any shape that provides a smooth exterior surface which supports the elastic properties of fluid flow may be employed. To achieve the ejection of droplets 12 of a desired size, the fluid depth must be maintained substantially within the focal plane of the acoustic lens 19. The radiation pressure of the converging acoustic tone bursts 42 acts to overcome the restraining force of surface tension and expel droplets 12 from the fluid surface 27. For lenses with low spherical aberration and an F/number of approximately 1.0, the diameter of the ejected droplets 12 scale inversely with acoustic frequency used to excite the electro-acoustic transducers 15. Droplet diameters from 300 to 5 microns would therefore correspond to an acoustic frequency range of 5 to 300 MHz.

The Nozzleless Droplet Projection System provides for constant renewal of an ink surface which reduces surface contamination problems which are common to many low-cost printing technologies. Disturbances in the laminar flow 26, including surface ripple waves due to droplet 12 ejection, are swept away before they can propagate to other points along the transducer array. The droplet 12 ejection rate may be varied without altering the laminar flow depth since the pressurized fluid input 31 is constantly regulated. The improvement realized by the curved trajectory of the laminar flow allows the spacing between projection surface and projection system to be as small as desired while maintaining larger clearances between the projection surface and the rest of the projection system.

The novel combination of knife-edge shaped laminar flow regulator 28 and a head structure having a smooth exterior perimetrical surface 18 provides a stable, fixed-depth, non-undulating film down stream from slit 30. The film continues to cling to the smooth surface 18 of the print head for an extended distance, facilitating the collection of any unused liquid ink without interfering with the paper path.

Although the present invention has been described in detail with reference to a particular preferred embodiment, persons possessing ordinary skill in the art to which this invention pertains will appreciate that various modifications and enhancements may be made without departing from the spirit and scope of the claims that follow. The List of Reference Numerals which follows is intended to provide the reader with a convenient means of identifying elements of the invention in the specification and drawings. This list is not intended to delineate or narrow the scope of the claims.

What is claimed is:

1. In an acoustic printer having a printhead (10) including an electroacoustic transducer (15) positioned in a head structure (16*a*) having a head cavity (16*b*) on a transducer support surface (17); said head structure (16*a*) including a droplet ejector acoustic lens (19) for generating a plurality of tone bursts (20) which produce an acoustic beam (42) which converges to eject a plurality of ink droplets (12) on demand from a supply of ink (33); said supply of ink (33) being pressurized by a regulated fluid pump (32) through a return (40), being cleaned by a filter (36), and being collected by a sump (38); an improved ink transport apparatus for delivering said supply of ink (33) to said printhead (10) comprising;

a head structure (16*a*) having a smooth perimetrical exterior surface (18); and a laminar flow regulator (28) being positioned to face and to extend towards said smooth perimetrical exterior surface (18) of said head structure (16*a*); said laminar flow regulator (28) utilizing an elastic action of tension forces created by forcing ink from a filtered fluid supply (35), pressurized by said regulated fluid pump (32), between said smooth perimetrical exterior surface (18) of said head structure (16*a*) and said laminar flow regulator (28) to control a thin-film laminar flow of ink (26);

said laminar flow regulator (28) having a pointed shape resembling a knife-edge and being precisely positioned to engage said filtered fluid supply (35) of ink and to enable the formation of a flow regulating meniscus of ink (46,48) between said laminar flow regulator (28) and said smooth perimetrical exterior surface (18); said meniscus of ink (46,48) being capable of regulating said thin-film laminar flow of ink (26) across and over said acoustic lens (19); whereby said thin-film laminar flow of ink (26) is maintained at a generally constant velocity and a generally constant depth which corresponds to the focal plane of said acoustic lens (19).

2. An apparatus as recited in claim 1, in which said flow regulating meniscus of ink (46,48) assists in the regulation of said thin-film laminar flow of ink by utilizing the elastic action of tension forces created by forcing said supply of ink between said smooth perimetrical exterior surface (18) and said laminar flow regulator (28) to create said meniscus of ink which is convex (46) if pressure increases and to create said meniscus of ink which is concave (48) if pressure decreases.

3. An apparatus as recited in claim 1, in which the maintenance of a continuous thin-film laminar flow of ink (26) at a constant velocity reduces surface contamination in said printhead (10).

4. An apparatus as recited in claim 1, in which an optimum size of said ejected ink droplets (12) is selected by varying a size of said meniscus of ink (46, 48) by adjusting the position of said laminar flow regulator (28) and said smooth perimetrical exterior surface (18).

5. An apparatus as recited in claim 1, in which disturbances in laminar flow caused by ink droplet (12) ejection are substantially eliminated by said meniscus (46,48) which attenuates surface ripple waves before said waves can propagate through said thin-film laminar flow of ink (26).

6. An apparatus as recited in claim 1, in a droplet ejection rate of said printhead is varied without altering laminar flow depth since said thin-film laminar flow of ink (26) is pressurized and is constantly regulated by said laminar flow regulator (28), by said smooth perimetrical exterior surface (18), and by said meniscus of ink (46,48).

* * * * *